United States Patent [19]

Holub

[11] Patent Number: 4,884,321

[45] Date of Patent: Dec. 5, 1989

[54] SHOE LACE GRIP

[76] Inventor: Elvin G. Holub, 5 Robby Rd., Shawnee, Okla. 74801

[21] Appl. No.: 223,510

[22] Filed: Jul. 25, 1988

[51] Int. Cl.[4] ..... A43C 7/00

[52] U.S. Cl. ..... 24/712.6; 24/712.2

[58] Field of Search ..... 24/117, 119, 120, 121, 24/129 R, 129 D, 169, 170, 198, 200; 36/50

[56] References Cited

U.S. PATENT DOCUMENTS

| | | | |
|---|---|---|---|
| 1,208,604 | 12/1916 | Markiewise | 24/121 |
| 2,650,399 | 9/1953 | Torelli . | |
| 2,911,697 | 11/1959 | Henderson | 24/117 |
| 3,108,343 | 10/1963 | Mo et al. | 24/121 |
| 3,967,347 | 7/1976 | Bickis, Sr. | 24/200 X |
| 4,395,803 | 8/1983 | Krauss | 24/200 |
| 4,715,094 | 12/1987 | Herdman | 24/120 X |

FOREIGN PATENT DOCUMENTS

| | | | |
|---|---|---|---|
| 403840 | 6/1909 | France | 24/121 |
| 2264498 | 10/1975 | France | 24/117 |

*Primary Examiner*—James R. Brittain

*Attorney, Agent, or Firm*—Robert K. Rhea

[57] ABSTRACT

A shoe lace or strand end portion locking device formed by a generally ovate body having a longitudinal slot between its ends bridged by spaced-apart parallel bars, with each bar having rough side and top surfaces. The body slot and parallel bars define opposing tortuous paths through which strand end portions are entrained and releaseably retained against longitudinal movement. The end portions of the strands may be further threaded through apertures in the body to define a strand end portion bow configuration.

2 Claims, 1 Drawing Sheet

SHOE LACE GRIP

BACKGROUND OF THE INVENTION

1. Field of the Invention

This invention relates to strand length adjusting fasteners and more particularly to a shoe lace loose end knot eliminating gripping device.

As is well known the end portions of a shoe lace are tied in a bow knot for ease in untying. These knots frequently work loose as a result of alternating pressure and release of pressure applied to the knot during walking or running and thus must be retied particularly in the case of many children who do not tie the knots sufficiently tight and who may not tie the knot known as a "square knot" as opposed to a different tie generally known as a "granny knot". Furthermore, the configuration of the laces such as are frequently used in athletic shoes which are generally loosely woven tend to become untied when compared with the shoe lace commonly used with dress shoes.

It is, therefore, desirable that some means be provided for securing the confronting end portions of shoe laces or other strands and which is at least as easily released as a bow knot tied shoe lace.

2. Description of the Prior Art

U.S. Pat. No. 2,650,399 discloses a disk-like shoe lace and knot retainer in which the retainer is provided with apertures and a recess on its periphery. The lace end portions are passed through the apertures from back to front and across the retainer periphery and bow knot tied behind the retainer in a manner to conceal the knot and present a decorative front appearance by the design on and/or shape of the retainer.

This invention is distinctive over this patent by providing a lace loose end retainer having a slot therein through which lace end portions are tortuously entrained in confronting relation and doubled back upon itself in a manner to secure the lace ends without tying until manually released.

Other patents disclose shoe lace end portion retainers generally requiring two or more components cooperating to grip a lace therebetween whereas this invention is unitary and yet grips and holds the lace ends in a lace tightened position.

SUMMARY OF THE INVENTION

In the preferred embodiment, a generally ovate plate is arcuately curved along its major axis substantially complementary with the transverse arcuate curve across a laced shoe. The plate is provided with a longitudinally extending slot between its ends open through its top and bottom surfaces. The slot is transversely bridged by a pair of parallel longitudinally spaced bars which project above and below the arcuate plane defined by the top surface of the plate. The bars form a tortuous path for the free end portion of shoe laces at the respective end portion of the slot. Additionally, the plate is longitudinally rabbeted between its ends laterally of the respective wall defining the sides of the slot. One of the rabbeted edges is provided with a pair of longitudinally spaced lace end portion receiving apertures.

In another embodiment, an elongated flap is integrally hinge connected, at one end, to one end of the plate for overlying snap fastening with the other end portion of the plate.

The principal object of this invention is to provide a shoe lace fastener which, when installed, remains on the shoe laces yet permits tightening of the laces and shoe vamps in accordance with the preference of the user yet is easily loosened for comfort or removing the shoe and which also maintains the free end portions of the laces extending beyond the grip in a neat bow tied appearing fashion.

DESCRIPTION OF THE PREFERRED EMBODIMENTS

Figure 1:
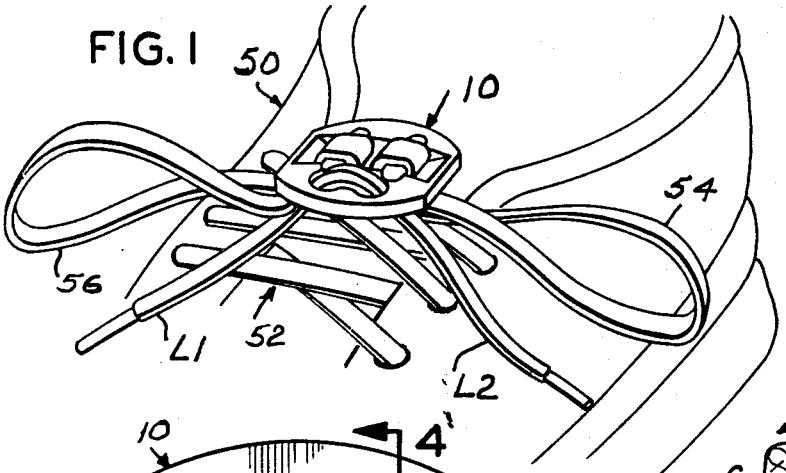
FIG. 1 is a fragmentary perspective view of the preferred embodiment of the device illustrating the lace end portions secured by the device.

Like characters of reference designate like parts in those figures of the drawings in which they occur.

In the drawings:

The reference numeral 10 indicates the preferred embodiment of the device which is generally ovate in top view having parallel end surfaces 12 and 14, respectively, vertically truncating the major axis and intersecting angular downward converging end surfaces 13 and 15. The thickness of the body is relatively thin when compared with the dimensions of its major and minor axes. The body 10 is preferably arcuately curved longitudinally on a desired radius complementing the generally arcuate surface defined by the laced vamp opening of a shoe when the device 10 is used for gripping shoe laces, as hereinafter explained.

Medially its width and between its ends, the body 10 is provided with a longitudinally extending slot 16 open through the body top and bottom surfaces 18 and 20 and characterized by opposing parallel vertical side walls 22 and 23 and downwardly and inwardly converging slot end surfaces 24 and 26 substantially parallel with the respective depending angular undercut end surfaces 13 and 15. The juncture of the respective wall surfaces 24 and 26, with the body bottom surface 20, is arcuately curved on a small radius, as at 28, and merges with a horizontal body end portion bottom surface 29 intersecting the respective depending angular converging end surface 13 and 15 to form a strand or lace impinging or pinch point for the purpose presently explained in more detail.

Figure 2:
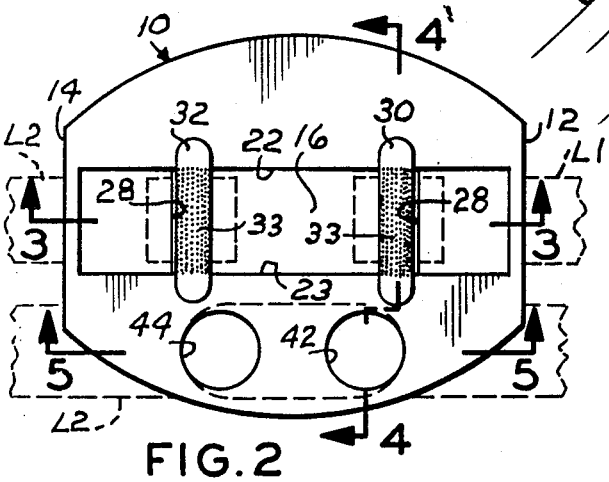
FIG. 2 is a top view of the device illustrating the lace end portions by dotted lines.

A pair of parallel bars 30 and 32 transversely bridge the slot in longitudinally spaced-apart relation and project above and below the arcuate plane defined by the body top surface 18. Each of the bars 30 and 32 are preferably trapezium-shaped in transverse section with all of its quandrilateral surfaces preferably having a rough sand paper-like texture, as indicated by the stipple shading 33 (FIG. 2), for inhibiting longitudinal sliding movement of a strand or lace relative to the respective bar when entrained therearound, as presently explained.

Opposing longitudinally generally upright surfaces of each bar converge downwardly toward the respective pinch point 28, the bar bottom surface 34 being generally parallel with the respective body slot end wall surfaces 24 and 26. Each bar top surface 36 angularly intersects its generally vertical side walls, preferably forming longitudinal sharp corners, further increasing the coefficient of sliding friction between the respective bar and a strand when transversely entrained thereover.

Figure 4:
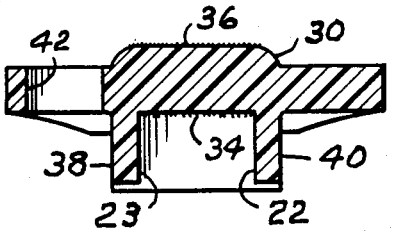
FIGS. 3, 4 and 5 are vertical cross sectional views taken substantially along the lines 3—3, 4—4 and 5—5, respectively, of FIG. 2.

As best shown by FIG. 4, the respective lateral bottom surface, outwardly of the slot 16, is longitudinally rabbeted, as at 38 and 40. One lateral side of the body 10 is provided with a pair of longitudinally spaced-apart vertical apertures 42 and 44 on a predetermined diameter for the purposes presently explained.

Figure 6:
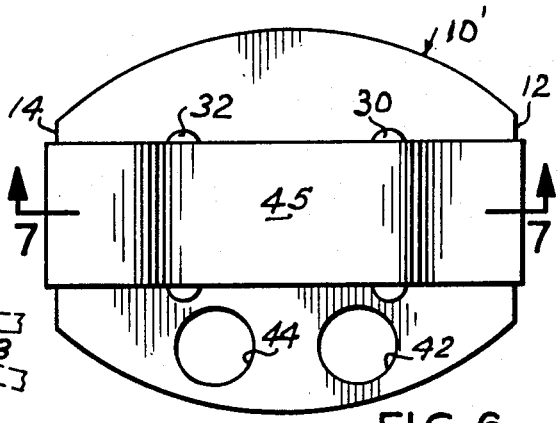
FIG. 6 is a top view of another embodiment.
Figure 7:
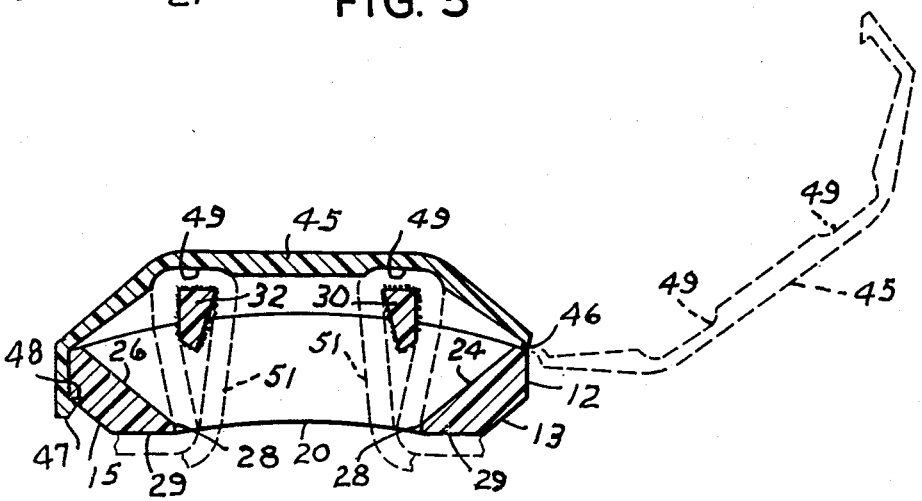
FIG. 7 is a vertical cross sectional view taken substantially along the line 7—7 of FIG. 6.

Referring now to FIGS. 6 and 7, the numeral 10' indicates another embodiment of the shoe lace grip which is substantially identical with respect to the above described embodiment 10 and in which identical reference numerals for identical parts are used. The embodiment 10' further includes a shoe lace cover or cap 45 which longitudinally overlies the slot 16 and laces entrained therethrough. The cap 45 is intended for shoe laces of the relatively small diameter hard surface type, as at 51, which generally feature a relatively low coefficient of sliding friction particularly when in contact with each other or a hard smooth surface. The cap 45 is generally relatively thin rectangular and is integrally connected, at one end, by a relatively thin portion of the material forming a hinge or pivot point 46. The opposite end of the body is provided with a hook-shaped latch 47 cooperatively engaging a notch 48 formed in the body end surface 14 for securing the cap in overlying relation with respect to the position of the lace end portions entrained over the bars 30 and 32. Intermediate its ends, the cap 45 is provided with a pair of transverse recesses 49 cooperatively overlying the respective bar 30 and 32 and in frictional contact with the respective lace when entrained thereover.

OPERATION

Figure 3:
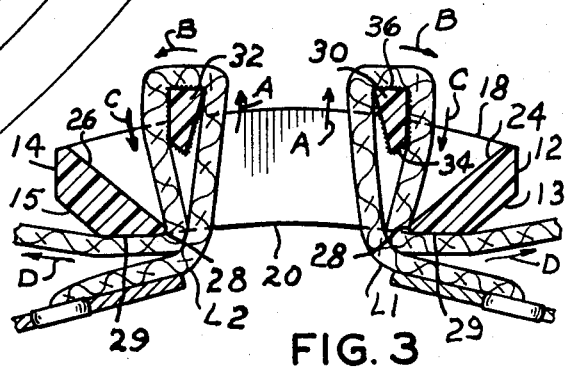
Figure 5:
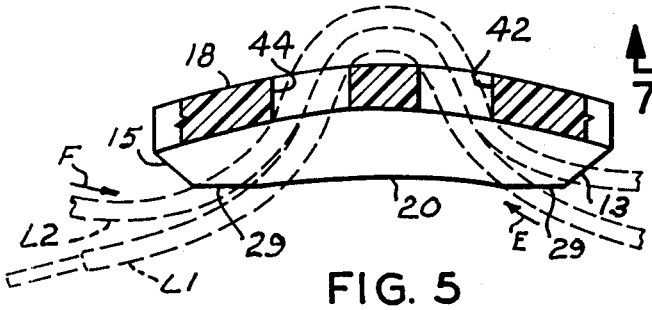

Referring more particularly to FIGS. 1 and 3, a shoe, fragmentarily illustrated at 50, has its vamps conventionally laced with a shoe lace 52. The lace end portions being designated L1 and L2. Each of the lace end portions L1 and L2 are manually extended upwardly through the central portion of the slot 16 between the pair of bars 30 and 32 in the direction of the arrow A, longitudinally toward opposing ends of the body in the direction of the arrow B, downwardly through the respective slot end portion in the direction of the arrow C and interposed between the pinch point 28 and underlying portion of the respective lace end portion and extended in opposing laterally outward directions, as shown by the arrow D. With both lace end portions L1 and L2 entrained in this fashion, a manual simultaneous pull on the respective lace end portion longitudinally of the lace draws the body 10 into firm contact with the user's laced shoe vamps by a longitudinal sliding action of the laces around the respective bar 30 and 32 which insures frictional contact of the pinch points 28 with the laces to normally prevent movement thereof relative to the body 10 or vice versa.

The laces and/or body is released from the laced position by simply manually lifting either end of the body 10 to release the lace pinch point contact allowing the respective lace end portion to longitudinally slide relative to the respective bar. Additionally, the lace end portions L1 and L2, projecting beyond the body 10 after being laced or strung therethrough, are preferably inserted through the apertures 42 and 44 in the direction of the arrow E for the lace L1 and in the opposite direction, as shown by the arrow F, for the lace L2 or vice versa. The lace end portions L1 and L2 are drawn through the apertures 42 and 44 a selected distance to provide a pair of bow-like loops 54 and 56 simulating a bow tied lace.

Operation of the alternative embodiment 10' is substantially identical with the above described operation of the first embodiment 10 with the exception that after stringing the lace end portions L1 and L2 through the body and tightening them to the desired tension, the cap 45 is manually closed and snapped in place. By its frictional contact with the laces by passing over the bars 30 and 32, the cap precludes any movement of small diameter hard surface laces relative to the body.

Obviously the invention is susceptible to changes or alterations without defeating its practicability. Therefore, I do not wish to be confined to the preferred embodiment shown in the drawings and described herein.

I claim:

1. A grip for the loose end portions of a strand, comprising:

an elongated body having top and bottom surfaces and having opposing ends, said body having a longitudinal slot open through its top and bottom surfaces medially its ends defined by opposing vertical side walls and end walls converging downward from the upper limit of the respective ends of the body and inwardly of said opposing body ends; and, means including a pair of spaced-apart bridging the central portion of the slot adjacent said top surface, for defining a pair of strand end portion tortuous paths at respective end portions of the body, said strand end portion tortuous paths extend inward from the ends of the body beneath its bottom surface, upwardly through the body centrally the length of the slot, transversely over the respective bar toward the respective said body end, downwardly adjacent the converging wall surfaces defining the end limits of the slot and longitudinally beyond the respective end of the body in doubled-back-upon-itself sliding friction relationship, said body being longitudinally arcuately bowed upward and further characterized by a pair of vertical apertures laterally of the slot for slidably receiving in superposed relation the strand end portions extending beyond said body ends, each bar of said pair of bars having roughened friction inducing surfaces in the area contacted by the end portions of a pair of strands when entrained therearound, whereby the intersection of the downwardly converging end walls with the body bottom surface form spaced-apart pinch points on a strand end portion when superposed under longitudinal tension thereunder.

2. A grip for the loose end portions of a strand, comprising:

an elongated body having top and bottom surfaces and having opposing ends, said body having a longitudinal slot open through its top and bottom surfaces medially its ends defined by opposing vertical side walls and end walls converging downward from the upper limit of the respective ends of the body and inwardly of said opposing body ends; and, means including a pair of spaced-apart bars bridging the central portion of the slot adjacent said top surface, for defining a pair of strand end portion tortuous paths at respective end portions of the body, each bar of said pair of bars having roughened friction inducing surfaces in the area contacted by the end portions of a pair of strands when entrained therearound, whereby the intersection of the downwardly converging end walls with the body bottom surface form spaced-apart pinch points on a strand end portion when superposed under longitudinal tension thereunder;

cover means longitudinally overlying the slot including an elongated cap hingedly connected at one end with one end of said body for vertical pivotal movement of the a cap toward and away from the upper limit of the body; and, fastener means cooperatively securing the other end of said cap with the other end of said body.

* * * * *